United States Patent [19]

Welton et al.

[11] 4,443,996

[45] Apr. 24, 1984

[54] FLEXIBLE SPUR HOLDERS AND SPURS

[76] Inventors: Charles L. Welton, Rte. 1, Box 505 V, Golden, Colo. 80401; Pershing R. Van Scoyk, 7193 W. 32nd Ave., Wheatridge, Colo. 80033

[21] Appl. No.: 289,808

[22] Filed: Aug. 3, 1981

[51] Int. Cl.[3] ..... A43C 17/02

[52] U.S. Cl. ..... 54/83 R; 36/74

[58] Field of Search ..... 54/83 R, 83 A; 36/74, 36/71.5; D30/31

[56] References Cited

U.S. PATENT DOCUMENTS 740,226 9/1903 Brown ..... 54/83 R 2,487,461 11/1949 McKinney ..... 54/83 R X

*Primary Examiner*—Robert P. Swiatek

*Attorney, Agent, or Firm*—Horace B. Van Valkenburgh

[57] ABSTRACT

A spur holder is formed of flexible material and has a rear body and sides connecting the body to a front loop, which is stretchable over the heel of the boot to engage the front of the heel, with the rear body disposed at the rear of the boot adjacent the upper edge of the heel. The rear body has a generally oval front edge and a rear edge corresponding generally to a portion of an ellipse, while each of the front and rear edges of the loop correspond generally to a flattened oval. A rib extends outwardly from the rear body and a portion of each of the sides, adjacent the inner edge of each and is adapted to engage a crevice above the heel when the holder is installed on a boot. A spur rowel and shank are attached to the rear body, as by a plate molded within the rear body or a cap which covers the plate and is vulcanized to the rear body. The inner edge of each of the sides may be provided with a taper opposite the rib to accommodate additional stretching of these edges. A spur is produced by molding an outwardly extending, integral button on the rear body.

12 Claims, 7 Drawing Figures

FLEXIBLE SPUR HOLDERS AND SPURS

This invention relates to flexible spur holders and spurs.

BACKGROUND OF THE INVENTION

There have been previous attempts to provide straps or other devices for holding spurs and prevent the rowel of the spur from falling down or riding up at the rear of the boot. Davis U.S. Pat. No. 71,462, Boos U.S. Pat. No. 1,882,059 and Smith U.S. Pat. No. 2,432,102 are examples of spur straps which include a lower strap passing under the sole of the boot and an upper strap passing over the instep of the boot. An improved tiedown strap for spurs is disclosed in the pending application of the present applicants, Ser. No. 255,232 filed Apr. 17, 1981. This tiedown strap is flexible, including a body having a hole which engages the spur shank and an opposite loop which extends around the heel at the underside of the sole of the boot. It is also provided with an ear extending upwardly to each side, to which an instep strap may be affixed. Such an instep strap may be a conventional buckel strap, or a flexible strap having a hole at each end which snaps over a button mounted at the front of the conventional side bar of the spur. This construction, however, requires a conventional mounting for the spur.

Among the objects of this invention are to provide a spur holder which is flexible and can be removably mounted on a boot without the necessity of additional straps, either tiedown straps or instep straps; to provide such a spur holder to which a spur shank and rowel may be attached, as by vulcanization or molding; to provide such a spur holder which can be relatively easily placed on or removed from the boot, without the necessity of unfastening any buckles, buttons or other connections; to provide such a spur holder which will hold the shank of the spur in a firm position at the rear of the boot and does not tend to come off the boot; to provide such a spur holder which is provided with an integral button which performs the functions of the rowel; and to provide such a spur holder and spur which are easily and economically manufactured.

SUMMARY OF THE INVENTION

A flexible spur holder of this invention includes a curved rear body and a front loop which are connected by arcuate sides, to form a hole which permits the loop to be stretched over the heel of a boot adjacent the sole. A cap, which may be vulcanized to the body, attaches a spur having a shank carrying a pivoted rowel at its outer end and an integral or attached plate at its inner end, with the cap overlying the plate. The opposite side of the body, from the cap, may be provided with a rib which extends around the hole and onto the sides. The rib is adapted to extend into the crevice between the heel and the counter-heel of the boot, to restrain upward or downward movement. The inner edge of each side may be tapered, to permit this portion to stretch when the holder is converted from a flat to a tubular shape when stretched around the heel to place the rowel at the rear. The spur holder is formed of a material, such as neophrene, having a very high resistance to fatigue stress. The spur shank and plate may be placed in the mold and the cap molded integrally with the remainder of the holder. Also, an integral button may extend from the body of the holder, to form a unitary spur.

THE DRAWING

DESCRIPTION OF THE PREFERRED EMBODIMENT

Figure 1:
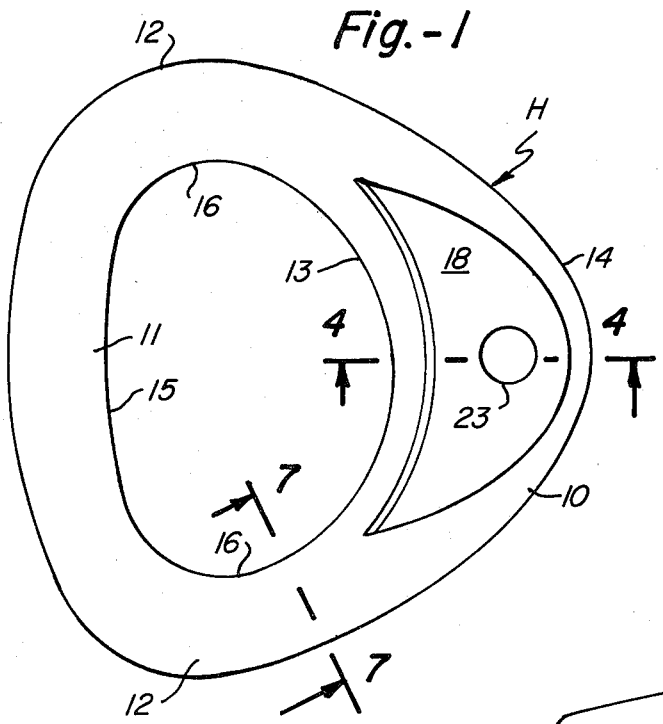
FIG. 1 is a top plan view of a flexible spur holder of this invention.
Figure 2:
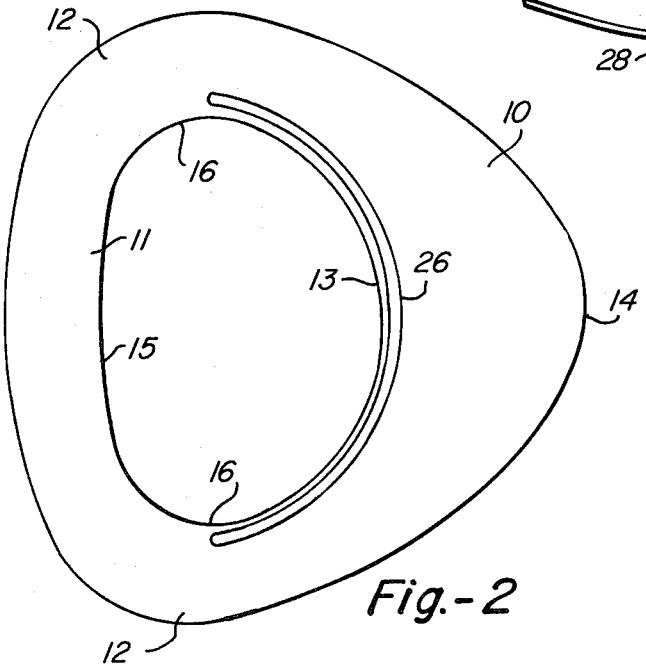
FIG. 2 is a botton plan view of the holder of FIG. 1.

As illustrated in FIGS. 1 and 2 of the drawing, a flexible spur holder H of this invention may include a curved rear body 10 and a front loop 11 which are connected by arcuate sides 12, with the front and rear edges 13, 14 of the body 10 being essentially elliptical in shape and the rear edge 15 of loop 11 being a flattened oval. The front edge of the rear body 10 and the rear edge of loop 11, with the inner edges 16 of sides 12, form a hole which permits the loop to be stretched over the heel 17 of a boot B, as in FIG. 3. Atop the body 10 is a cap 18 which may be vulcanized to the body 10, as in FIG. 4, for attaching a spur having a shank 20 carrying a pivoted rowel 21 at its outer end and an integral or attached plate 22 at its inner end, with the cap overlying the plate. Cap 18 is provided with a hole 23 through which shank 20 extends, while hole 23 has an inner enlargement 24, as shown, to receive plate 22. The spur holder H is further provided with a rib 26 on the underside, as in FIGS. 2, 4 and 7, which is spaced from edge 13 of body 10 and a segment of edge 16 of each side 12, for a purpose hereinafter described.

The front edge of cap 18 may be spaced from front edge 13 of body 10, while the rear edge of the cap may be spaced further away from rear edge 14 of body 10 as it extends forwardly, as shown in FIG. 1. The spur holder H is formed of a tough but resilient material which can be stretched but will exert a reasonably strong pull. The material of the spur holder should also have a very high resistance to fatigue stress, since it may be stretched and pulled and permitted to retract hundreds or thousands of times during a useful life. A suitable material comprises molded neoprene, such as having the trade designation NIL-R 3065 SC 515, with a tensile strength of approximately 15,000 pounds per square inch.

Figure 3:
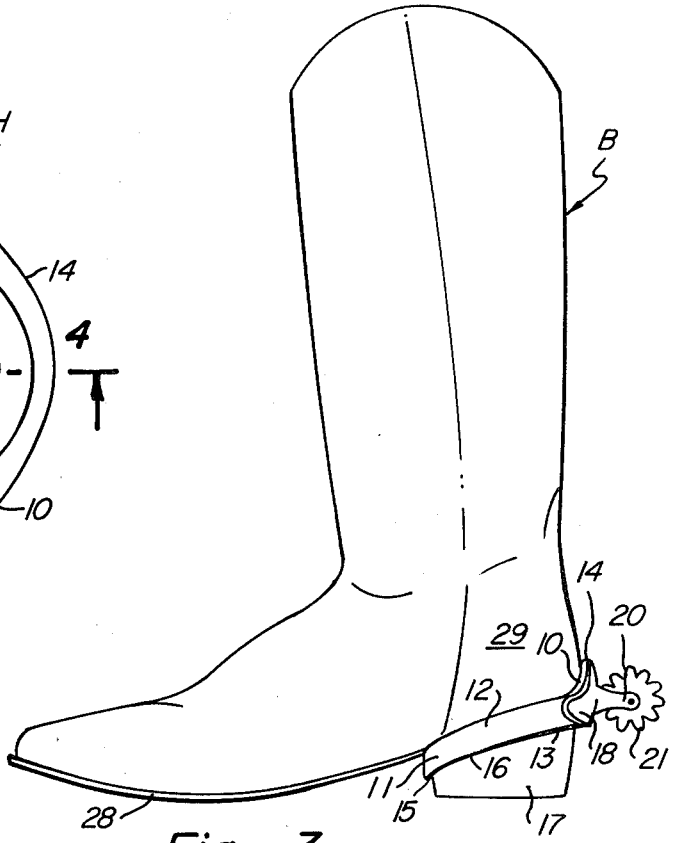
FIG. 3 is a side elevation, on a reduced scale, of a flexible holder and spur of this invention mounted on a boot.

The holder, as indicated, is adapted to fit around heel 17 of boot B, with the front loop 11 engaging the front of the heel and the front corners of the heel, beneath sole 28. The sides 12 extend along the sides of the heel and the body 10 fits against the remainder of the sides of the heel and the counterheel 29 of the boot. In installing the holder H, the underside of the body 10 is moved upwardly along the heel at the rear, with its rear edge 14 upwardly and its front edge 13 downwardly, so that the edge 15 of loop 11 will be down and the loop will be flat against the front of the heel. Thus, the holder H will encircle the heel without any twist in the loop or sides. In the position of FIG. 3, the rib 26 will engage the crevice between the heel 17 and the counterheel 29.

Figure 4:
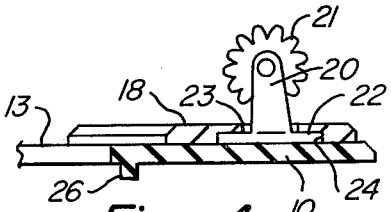
FIG. 4 is a cross section, on an enlarged scale, taken along line 4—4 of FIG. 1.
Figure 5:
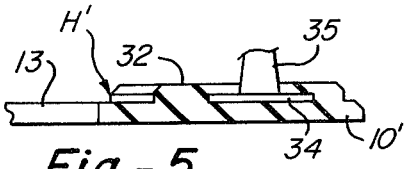
FIG. 5 is a cross section corresponding to FIG. 4 but showing an alternative attachment of the spur shank to the holder.
Figure 6:
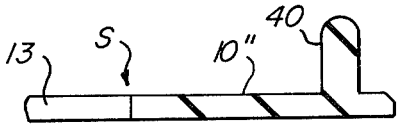
FIG. 6 is a cross section corresponding to FIG. 4 but showing an alternative construction having a molded button in lieu of the rowel.

In an alternative holder H' illustrated in FIG. 5, the spur holder is provided with an alternative rear body 10' having an integral molded cap 32, which encloses a plate 34 integral with a stem 35 which forms a shank, to the outer end of which a rowel 21 of FIG. 4 may be attached. In the alternative construction of FIG. 6, an integrally molded button 40 extends from a further alternative rear body 10" of a spur S. The button 40 is used for the same purpose as the rowel 21, but the spur S is adapted to be used by those who prefer a less vigorous prodding of the horse. The remainder of the spur S may be similar to the remainder of the holder H of FIG. 1.

Figure 7:
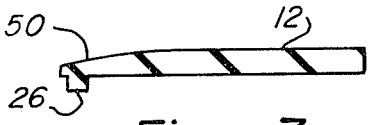
FIG. 7 is a cross section, on a further enlarged scale, taken at the position of line 7—7 of FIG. 1 but showing an alternative construction having a taper to permit stretching of particular edges.

In the alternative construction illustrated in FIG. 7, the inner edge of each side 12 is provided with a taper 50, which will be on the lower edge of side 12, on the outside of the heel 17 when the spur holder is installed, thereby permitting the side edges 16 to stretch more readily to accommodate the different position of the parts, i.e. the sleeve-like position, shown in FIG. 3, as compared with the flat position as molded, shown in FIG. 1.

As will be evident, in addition to the clamping action provided by the resiliency of the spur holder, rib 26 assists in maintaining the spur in position, without riding up or down. The spur holder of this invention is readily placed and removed from the boot and also could be left on the boot when the boot is removed, since there is no instep strap to resist pulling the boot off the foot.

The spur S of this invention illustrated in FIG. 5 is similarly relatively simple to place on the boot and remove and also does not require any unlatching or unfastening of any type of connection.

Although different embodiments of this invention, including an embodiment which provides a complete molded spur, are illustrated and described, it will be understood that other embodiments may exist. It will also be understood that other variation may be made without departing from the spirit and scope of this invention.

What is claimed is:

1. A spur holder, for a spur having a shank and a rowel mounted on said shank and for holding said spur on a boot having a sole and a heel, comprising:

a rear body and sides connecting said body to a front loop, said holder being formed of flexible material, whereby said front loop may be stretched over said heel to engage the front of said heel with said rear body disposed at the rear of said boot adjacent the upper edge of said heel, said sides stretched between said front loop and said rear body in an essentially straight direction; and means for attaching said shank to said rear body.

2. A spur holder as defined in claim 1, wherein:

said shank is provided with an inner plate attached to said rear body by molding said body around said plate.

3. A spur holder as defined in claim 1, wherein:

said sides are provided with a taper along an inner edge thereof.

4. A spur holder as defined in claim 1, wherein:

said rear body has a front edge and a rear edge; and said front edge of said rear body is generally oval and said rear edge thereof corresponds generally to a portion of an ellipse.

5. A spur holder as defined in claim 4, wherein:

a cap having a front edge, a rear edge and side edges overlies said rear body having side edges;

said front edge of said cap is adjacent and corresponds in shape to the front edge of said rear body;

said rear edge of said cap is adjacent said rear edge of said rear body; and said side edges of said cap are spaced at increasing distances from the side edges of said rear body in a forward direction.

6. A spur holder as defined in claim 4, wherein:

said loop has a front edge and a rear edge; and the front and rear edge of said loop each correspond generally to a flattened oval.

7. A spur holder, for a spur having a shank and a rowel mounted on said shank and for holding said spur on a boot having a sole and a heel, comprising:

a rear body and sides connecting said body to a front loop, said holder being formed of flexible material, whereby said front loop may be stretched over said heel to engage the front of said heel with said rear body disposed at the rear of said boot adjacent the upper edge of said heel;

a cap constructed and arranged to overlie a plate attached to said shank to attach said shank to said rear body, said cap being attachable to said rear body by vulcanization and the like; and means for attaching said shank to said rear body.

8. A spur holder for a spur having a shank and a rowel mounted on said shank and for holding said spur on a boot having a sole and a heel, comprising:

a rear body and sides connecting said body to a front loop, said holder being formed of flexible material, whereby said front loop may be stretched over said heel to engage the front of said heel with said rear body disposed at the rear of said boot adjacent the upper edge of said heel;

a rib extending outwardly from said rear body and at least an adjoining portion of said sides adjacent the inner edges thereof and positioned to engage a crevice above the heel of said boot when said holder is installed on said boot; and means for attaching said shank to said rear body.

9. A spur holder as defined in claim 8, wherein:

said sides are provided with a taper along the inner edges thereof, on the side of said holder opposite said rib.

10. A spur for use with a boot having a heel comprising:

a rear body and sides connecting said body to a front loop;

means, for engaging an animal, extending rearwardly from said rear body;

said spur being formed of flexible material and said rear body, sides and front loop being constructed and arranged whereby said front loop may be stretched over said heel to engage the front of said heel with said rear body disposed at the rear of said boot adjacent the upper edge of said heel and said sides stretched between said front loop and said rear body in generally straight lines.

11. A spur for use with a boot having a heel comprising:

a rear body and sides connecting said body to a front loop;

means, for engaging an animal, extending transversely from said rear body;

said spur being formed of flexible material, whereby said front loop may be stretched over said heel to engage the front of said heel with said rear body disposed at the rear of said boot adjacent the upper edge of said heel; and a rib extending outwardly from said rear body and at least an adjoining portion of said sides, adjacent the inner edges thereof, said rib being positioned to engage a crevice above the heel of said boot when said spur is installed.

12. A spur as defined in claim 10, wherein:

said rear body and said loop each have a front edge and a rear edge;

the front edge of said rear body is generally oval and the rear edge thereof corresponds generally to a portion of an ellipse; and the front edge and rear edge of said loop each correspond generally to a flattened oval.

* * * * *